US007651410B2

(12) United States Patent
Shimazaki

(10) Patent No.: US 7,651,410 B2
(45) Date of Patent: Jan. 26, 2010

(54) GOLF CLUB HEAD

(75) Inventor: Hideo Shimazaki, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 246 days.

(21) Appl. No.: 11/607,944

(22) Filed: Dec. 4, 2006

(65) Prior Publication Data

US 2007/0129169 A1 Jun. 7, 2007

(30) Foreign Application Priority Data

Dec. 2, 2005 (JP) ..... 2005-349785

(51) Int. Cl.
*A63B 53/04* (2006.01)

(52) U.S. Cl. ..... 473/335; 473/345; 473/346; 473/349

(58) Field of Classification Search ..... 473/324–350
See application file for complete search history.

(56) References Cited

U.S. PATENT DOCUMENTS 5,056,705 A * 10/1991 Wakita et al. ..... 228/176
5,913,735 A * 6/1999 Kenmi ..... 473/338
5,967,905 A * 10/1999 Nakahara et al. ..... 473/345
6,206,789 B1 * 3/2001 Takeda ..... 473/335
6,533,679 B1 * 3/2003 McCabe et al. ..... 473/335

FOREIGN PATENT DOCUMENTS

JP 9-266964 A 10/1997
JP 3052997 A 7/1998
JP 2003-093557 * 2/2003
JP 2005-211438 A 8/2005

* cited by examiner

*Primary Examiner*—Sebastiano Passaniti
(74) *Attorney, Agent, or Firm*—Sughrue Mion, PLLC

(57) ABSTRACT

A golf club head that includes: a pedestal composed of at least two ribs each having convex portions at both ends and formed on an inner face of the head; a metal weight disposed on the ribs; and a weld bead extending on a surface of the weight between the convex portions, the weight being fixed on the inner face of the head by the weld bead.

7 Claims, 8 Drawing Sheets

GOLF CLUB HEAD

BACKGROUND OF THE INVENTION

1. Field of the Invention

The present invention relates to a hollow golf club head in which a metal weight is welded on the inner face of the head.

2. Description of the Related Art

Conventionally, a hollow golf club head in which a weight made of a metal having a large specific gravity is welded on the inner face of a sole portion has been proposed to adjust the centroid position or weight of the golf club head. JP-A-9-266964, JP-A-2005-211438 and Japanese Utility Model No. 3052997, for example, disclose such a golf club.

The golf club head disclosed in JP-A-9-266964 is a metal golf club head that is hollow in the inside, in which a metal member having a larger specific gravity than the material of a head main body is welded on the hollow side of a bottom wall portion forming a sole of the head main body, and a deposited metal by the welding is swollen from the bottom wall portion and covered over an upper portion of the metal member.

The golf club head disclosed in JP-A-2005-211438 comprises a head portion made of metal and having an outer shell structure, a plurality of post portions spaced and stood on the surface of a sole portion in the head portion, and a weight member disposed near the post portions in the sole portion and joined with the post portions via a welded part.

The golf club head disclosed in Japanese Utility Model No. 3052997 comprises a weight member having a larger specific gravity than the head main body that is fixed on the inner face of the head main body, in which the weight member is welded on the inner face of the head main body, and a deposited metal by the welding extends from the inner face of the head main body to the upper face of the weight member.

SUMMARY OF THE INVENTION

In recent years, the golf club head has a larger size and a smaller weight, and accordingly the metal forming the golf club head is thinner. And the inner face of a sole portion is made a curved surface as the metal forming the golf club head is thinner.

Therefore, if a plate-like metal weight 52 is welded on the curved inner face of a sole portion 50 by the conventional technology, an interstice 54 occurs between the inner face of the sole portion 50 and the weight 52, whereby the welding of the weight 52 on the inner face of the sole portion 50 is instable, as shown in FIG. 13. That is, the position of the weight is shifted, or the weight is instable and not easily welded. In FIG. 13, reference numeral 56 denotes a weld bead.

To prevent the interstice 54 from occurring, it is contrived that a planar pedestal 58 is formed on the inner face of the sole portion 50, as shown in FIG. 14. However, this planar pedestal 58 has a problem that the weight of the pedestal itself is large, resulting in the larger weight of the golf club. Also, if a plurality of planar pedestals are formed on the inner face of the head, the weight of the head main body itself is very large, whereby it is difficult to form the plurality of planar pedestals on the inner face of the head. That is, if the plurality of planar pedestals are provided, the pedestal portion is significantly heavy, whereby it is difficult to design the weight finely with a plurality of weight.

Moreover, in the conventional technology, the formation position of the weld bead is not defined beforehand, whereby the weight of the weld bead is varied, often resulting in the varied head weight.

This invention has been achieved in the light of the above-mentioned problems, and it is an object of the invention to provide a golf club head having a pedestal for fixing a metal weight on an inner face of the head by welding using a weld bead, wherein the weight can be stably fixed on the inner face of the head, a plurality of pedestals can be provided on the inner face of the head without increasing the head weight significantly, a variation in the weight of weld bead can be suppressed to reduce a variation in the head weight, and the weight can be designed finely.

An aspect of the invention provides a golf club head comprising: a pedestal composed of at least two ribs each having convex portions at both ends and formed on an inner face of the head; a metal weight disposed on the ribs; and a weld bead extending on a surface of the weight between the convex portions, the weight being fixed on the inner face of the head by the weld bead.

Since a pedestal composed of at least two ribs is formed on an inner face of the head, a weight is disposed on the ribs, the weight can be stably disposed on the inner face of the head, whereby the weight can be stably fixed on the inner face of the head without forming the planar pedestal on the inner face of the head. Also, in this invention, since the pedestal is formed by the ribs, the weight of the pedestal is smaller than where the planar pedestal is formed on the inner face of the head, whereby a plurality of pedestals can be formed on the inner face of the head without increasing the weight of the head significantly, with the greater degree of freedom in designing the head. Further, in this invention, since the weld bead is formed between the convex portions provided at both ends of the rib, the formation position of the weld bead is defined beforehand, making it possible to suppress a variation in the weight of the weld bead and reduce a variation in the weight of the head.

It is preferred that an upper end of the rib and a back face of the weight are flat, that is, the upper end of the rib is linear or planar, and the back face of the weight is planar. In this way, the upper end of the rib and the back face of the weight are placed in line contact or face contact, whereby the weight is fixed on the inner face of the head extremely stably.

The formation position of the pedestal is not specifically limited. For example, the rib can be formed on the inner face of the sole portion, the side portion (toe side portion, heel side portion or back side portion). Also, in this invention, since the pedestal is formed by the ribs, the pedestal can be formed extending over the inner face of the sole portion and the inner face of the side portion (same as above), or over different regions, by providing the ribs between the inner face of the sole portion and the inner face of the side portion (same as above).

Though the shape, number and arrangement form of the ribs forming the pedestal can be appropriately set up, it is preferred that two ribs parallel to each other, linear in plan view, are provided. Thereby, the weight is fixed stably on the inner face of the head, the weight of the pedestal is reduced, and the positioning function of the weight in the transverse direction is provided for the convex portions at both ends of the rib.

Though the material or molding method of each portion of the golf club head is not limited, the material may be titanium, titanium alloy, stainless steel, marageing steel, aluminum alloy or amorphous, for example, and the molding method may be casting or forging method. However, the portion provided with the pedestal, which is complex in the shape, is preferably made by casting method. Also, the thickness (not including the height of the rib and convex portion) of the portion provided with the pedestal in the golf club head is as thin as from 0.3 to 1.2 mm, suitably from 0.5 to 0.8 mm. According to this invention, the weight can be fixed stably without deforming such a thinner portion.

Though the material or shape of the weight made of metal is not limited, the material may be metal different from the head main body, and having a greater specific gravity (specifically a specific gravity of 7.8 or more, preferably 10 or more) than the material of the head main body, for example, suitably tungsten or tungsten alloy. The shape of the weight may be like a rectangular plate, for example, but is not limited to it. The invention is particularly effective in the case where the weight made of a material such as tungsten or tungsten alloy that is relatively difficult to weld is fixed using the bead.

The weld bead extending on the surface of the weight is formed between the convex portions at both ends of the rib using the weld rod, and the inner face of the head and the weight are fixed by the weld bead. In this case, it is preferred that the metal forming the weld bead is the same metal as the head main body in principle. However, similar metal materials may be employed. Specifically, the head main body may be formed from titanium alloy (Ti-6Al-4V) by casting, and a weight of tungsten alloy arranged on the pedestal of the head main body may be fixed to the pedestal by the weld bead of pure titanium using the weld rod of pure titanium. The material of pure titanium is preferable, because pure titanium is cheaper in the cost and easier to handle than titanium alloy.

When a plurality of pedestals are provided on the inner face of the head, the number of pedestals is suitably 2 to 4. And the weight is appropriately fixed on one or more of the plurality of pedestals, whereby the golf club head in which the centroid position or weight of the head is varied can be easily fabricated using one mold.

In the hollow golf club head according to the aspect of the invention, the weight can be stably fixed on the inner face of the head, a plurality of pedestals can be provided on the inner face of the head without increasing the head weight significantly, a variation in the weight of weld bead can be suppressed to reduce a dispersion in the head weight, and the weight can be designed finely.

DETAILED DESCRIPTION OF THE PREFFERED EMBODIMENTS

Figure 1:
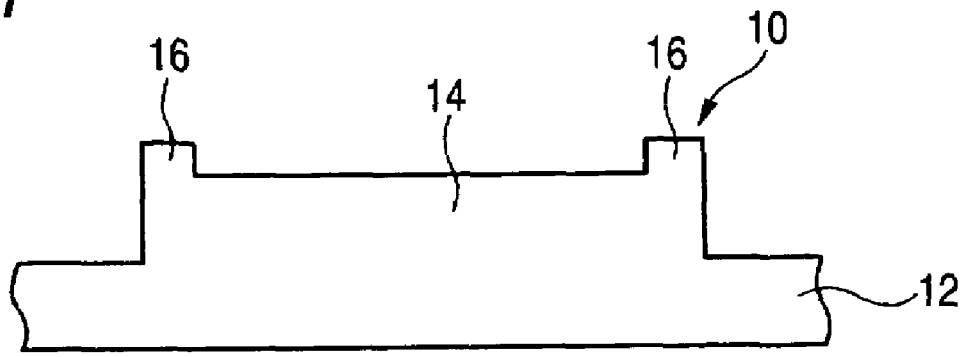
FIG. 1 is a front view showing one example of a pedestal for a golf club head according to an embodiment of the present invention.
Figure 2:
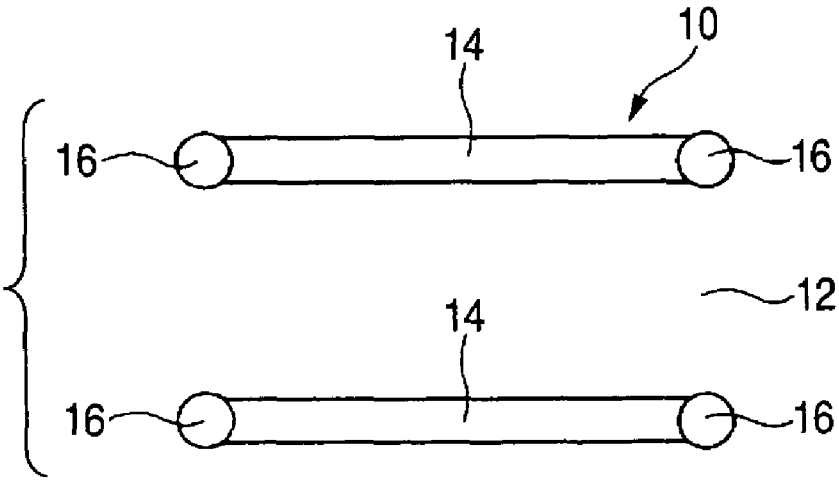
FIG. 2 is a plan view of the pedestal.
Figure 3:
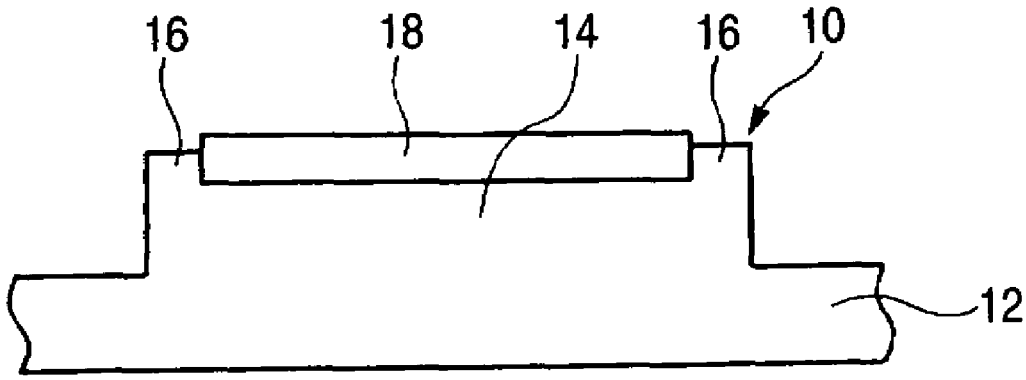
FIG. 3 is a front view showing a state where a weight is disposed on the pedestal.
Figure 4:
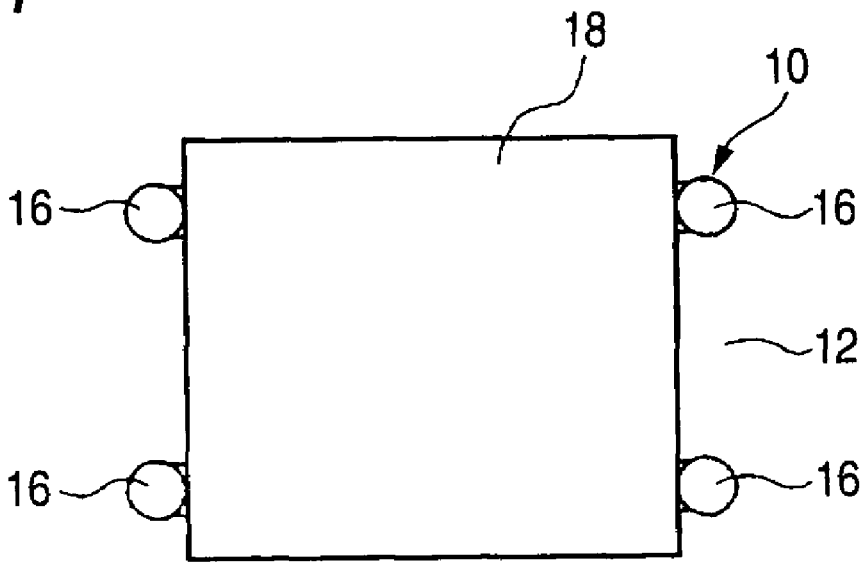
FIG. 4 is a plan view of the state.
Figure 5:
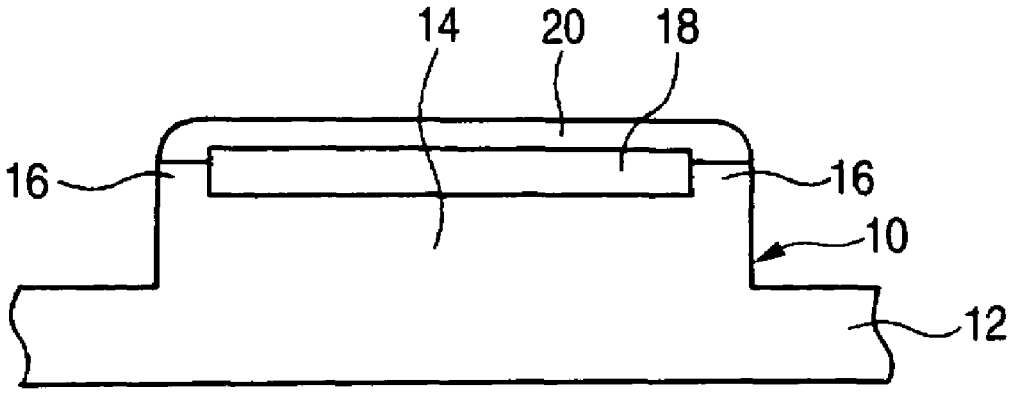
FIG. 5 is a front view showing a state where the weight is welded on the pedestal.
Figure 6:
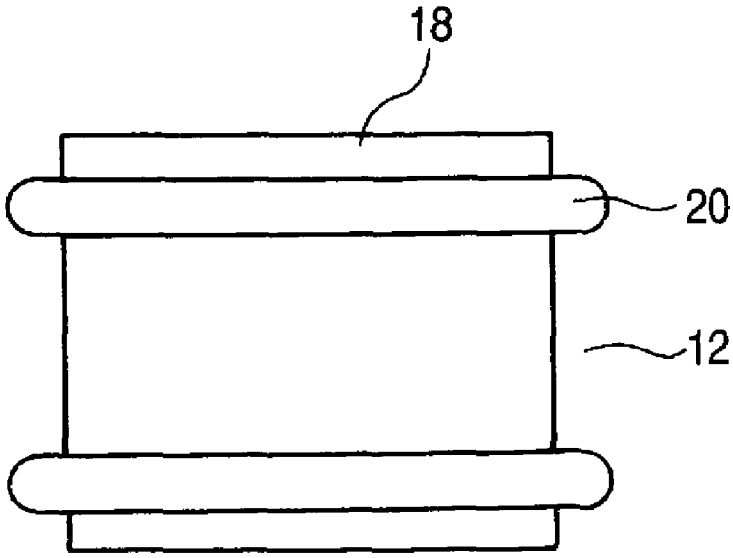
FIG. 6 is a plan view of the state.

Embodiments of the present invention will be described below with reference to the drawings, though the invention is not limited to the following embodiment. FIG. 1 is a front view showing one example of a pedestal for a golf club head according to an embodiment. FIG. 2 is a plan view of the pedestal. FIG. 3 is a front view showing a state where a weight is disposed on the pedestal. FIG. 4 is a plan view of the state. FIG. 5 is a front view showing a state where the weight is welded on the pedestal. FIG. 6 is a plan view of this state.

The pedestal 10 of this embodiment is composed of two parallel ribs 14, 14 in the same shape of rectangular plate, linear in plan view, which are formed on the inner face of a head main body 12. Convex portions 16, 16 of post shape are formed at both ends of each of the ribs 14, 14.

A procedure for fixing a metal weight on the inner face of the golf club head using the pedestal 10 of this embodiment is as follows.

(1) A rectangular plate-like weight 18 is disposed between the convex portions 16, 16 on the ribs 14, 14, as shown in FIGS. 3 and 4. In this case, the weight 18 can be positioned in the transverse direction by the convex portions 16, 16.

(2) A weld bead 20 extending on the surface of the weight 18 is formed between the convex portions 16, 16, using a weld rod, whereby the weight 18 is fixed on the inner face of the head main body 12 using this weld bead 20, as shown in FIGS. 5 and 6.

Figure 7:
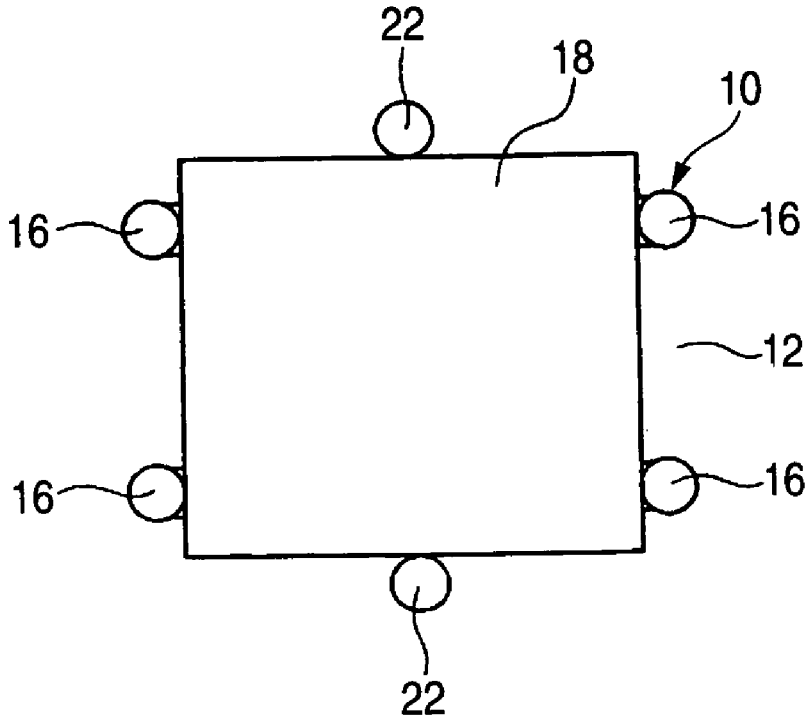
FIG. 7 is a plan view showing a pedestal with protruding portions for positioning the weight in the longitudinal direction.
Figure 8:
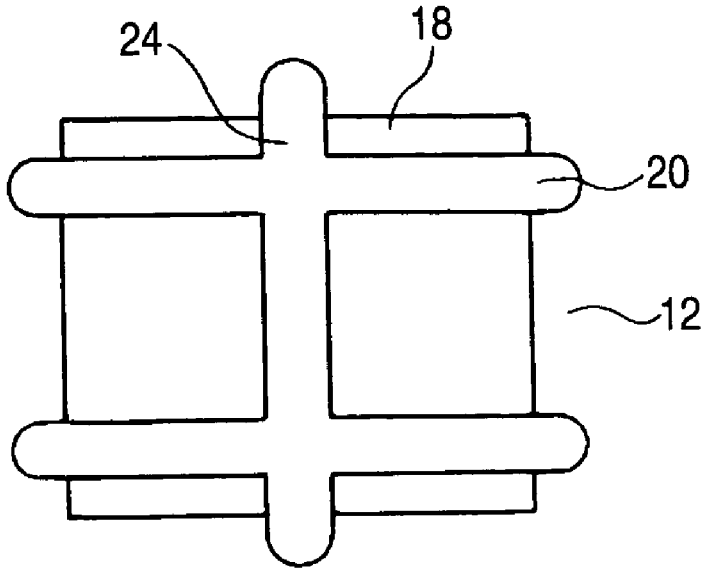
FIG. 8 is a front view showing a state where the weight is welded on the pedestal.

The golf club head of this invention is not limited to the above embodiment, but may be changed in various ways. For example, a pair of post-like convex portions 22, 22 for positioning a weight 18 in the longitudinal direction may be formed on the inner face of the head main body 12 to dispose the weight 18 between the convex portions 22, 22, as shown in FIG. 7, and a weld bead 24 extending on the surface of the weight 18 may be disposed between the convex portions 22, 22.

Figure 9:
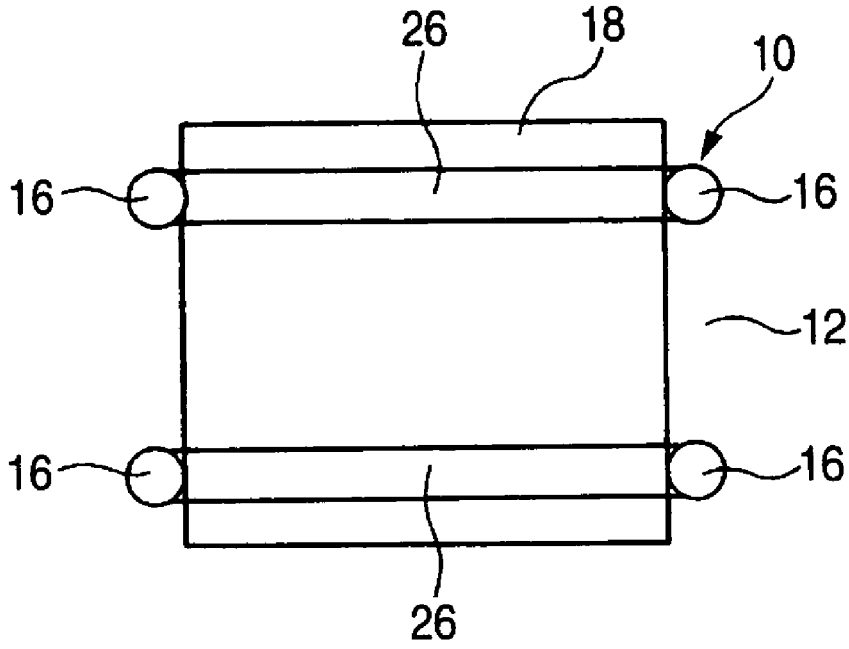
FIG. 9 is a plan view showing a weight provided with grooves for passing the weld bead on the surface.
Figure 10:
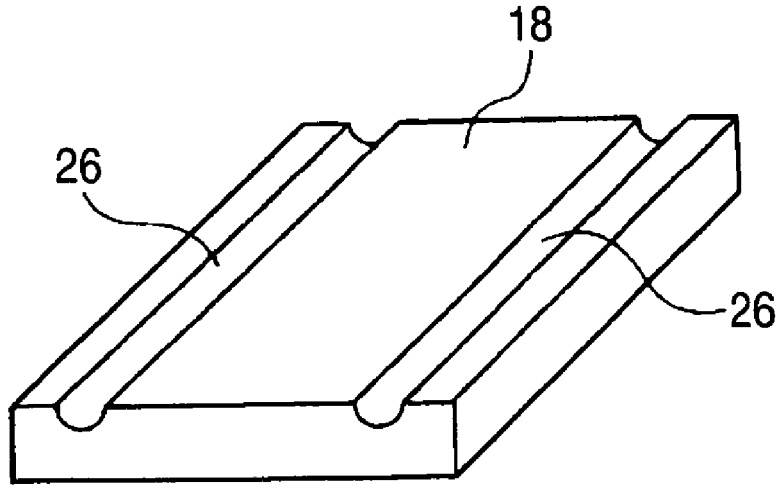
FIG. 10 is a perspective view showing the weight provided with the grooves for passing the weld bead on the surface.

Also, a groove 26, semi-circular or triangular in cross section, for passing the weld bead may be provided on the surface of the weight 18, as shown in FIGS. 9 and 10.

Figure 11:
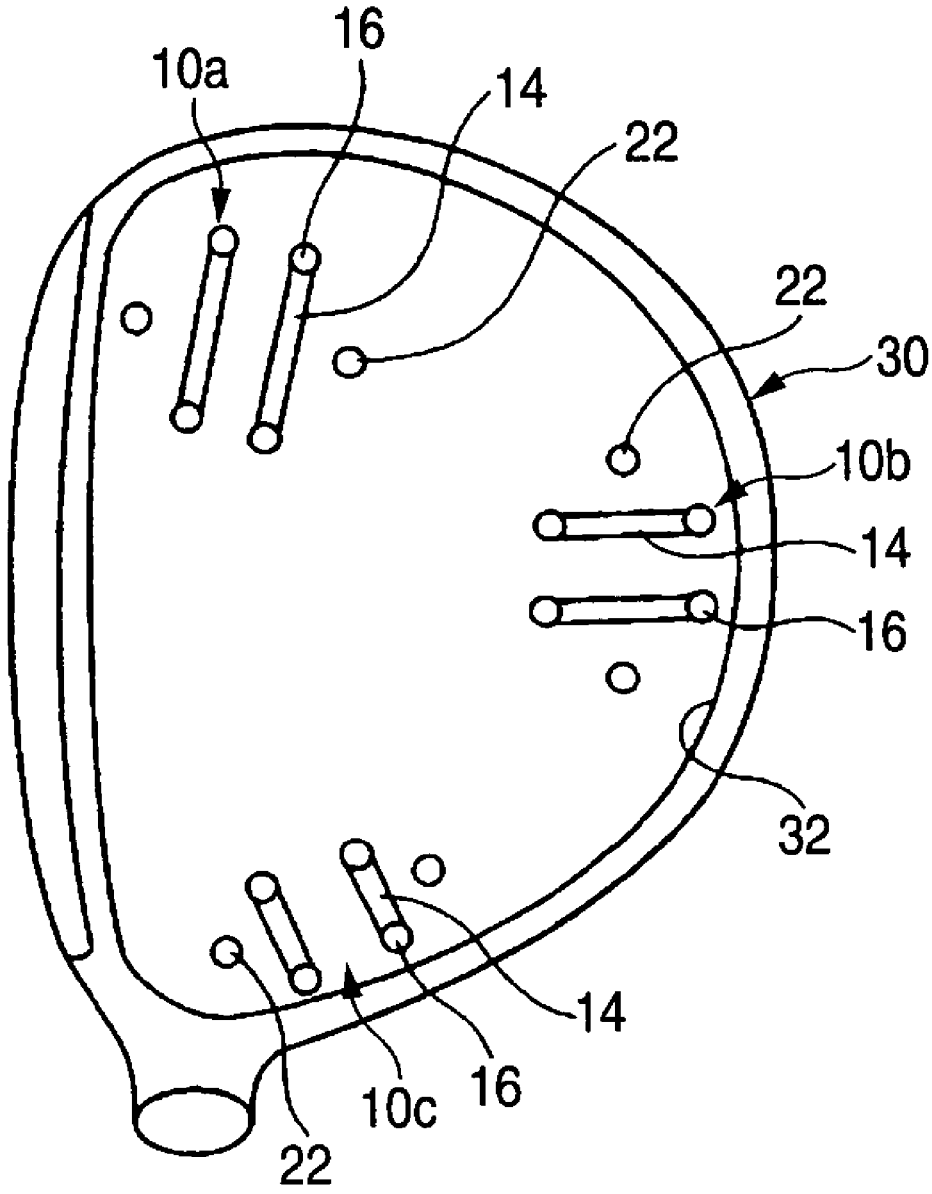
FIG. 11 is a plan view showing a head main body provided with a plurality of pedestals on its inner face.
Figure 12:
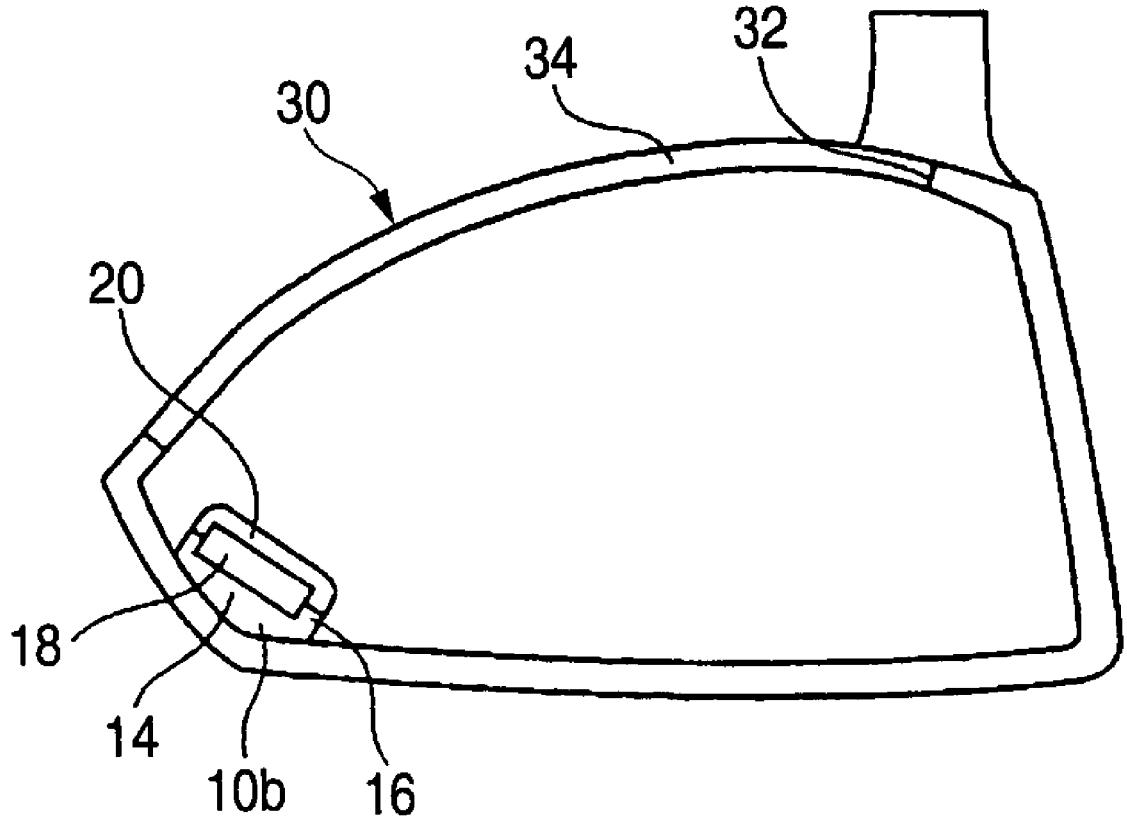
FIG. 12 is a cross-sectional view showing a state where a weight is fixed on the pedestal extending over the inner face of a sole portion and the inner face of a back side portion.
Figure 13:
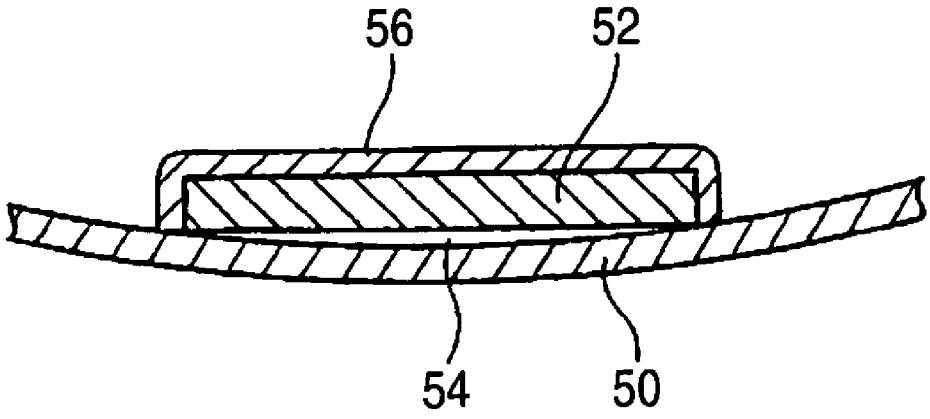
FIG. 13 is a cross-sectional view showing a state where a weight is welded on a curved inner face of a sole portion.
Figure 14:
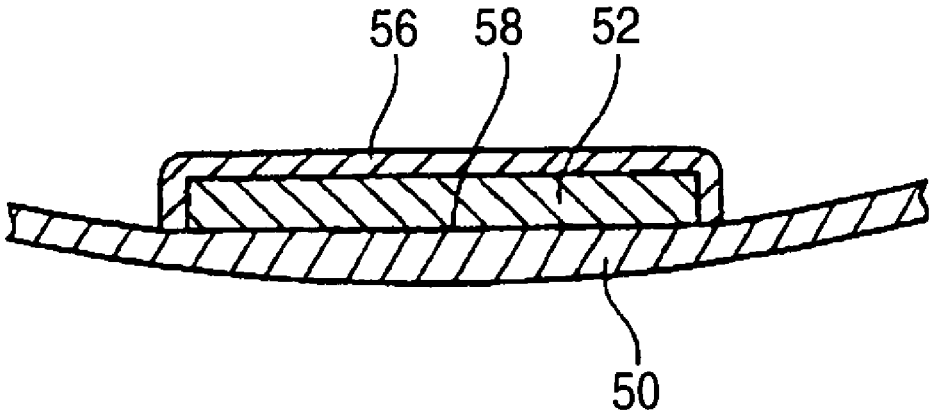
FIG. 14 is a cross-sectional view showing a state where a planar pedestal is formed on the inner face of the sole portion.

Moreover, a plurality of pedestals can be provided on the inner face of the head main body, as shown in FIG. 11. The golf club head shown in FIG. 11 has a pedestal 10*a* formed at the toe side on the inner face of the sole portion, a pedestal 10*b* formed extending over the inner face of the sole portion and the inner face of the back side portion, and a pedestal 10*c* formed extending over the inner face of the sole portion and the inner face of the heel side portion. Each of the pedestals 10a, 10*b* and 10*c* comprises the two parallel ribs 14, 14 in the same shape of rectangular plate, linear in plan view, which are formed on the inner face of a head main body 30, and formed with the post convex portions 16, 16 at both ends. Also, each of the pedestals 10*a*, 10*b* and 10*c* additionally has a pair of convex portions 22, 22 for positioning the weight in the longitudinal direction. FIG. 12 shows a state where the weight 18 is fixed on the pedestal 10*b* extending over the inner face of the sole portion and the inner face of the back side portion by the weld bead 20.

The head main body 30 of this embodiment has an opening portion 32 in a crown portion, the weight is fixed on one or more of the pedestals 10*a*, 10*b* and 10*c* by performing a welding operation through the opening portion 32. Then, a crown member 34 is fixed to the opening-portion 32 to close the opening portion 32, as shown in FIG. 12. This invention is particularly effectively applied to the golf club head comprising the head main body having this crown opening portion and the crown member for closing it.

What is claimed is:

1. A golf club head comprising:

a substantially hollow club head body having an inner face formed on at least one of a heel side portion, toe side portion and sole portion of the club head body;

a pedestal composed of at least two ribs each having projecting portions at both ends and formed on the inner face of the head;

a metal weight disposed on the ribs; and a weld bead extending on a surface of the weight between the projecting portions, the weight being fixed on the inner face of the head by the weld bead; and a plurality of post projections, disposed on the inner face and separate from the at least two ribs, for positioning the weight in a longitudinal direction of the weight.

2. The golf club head according to claim 1, wherein an upper end of the rib and a back face of the weight are flat.

3. The golf club head according to claim 1, wherein the projecting portions at both ends of the rib position the weight in a transverse direction of the weight.

4. The golf club head according to claim 1, wherein the at least two ribs extend lineally in a plan view and are parallel to each other.

5. The golf club head according to claim 1, wherein a plurality of the pedestals are formed on the inner face of the head.

6. The golf club head according to claim 1, wherein the weight has at least one groove on the surface of the weight for passing the weld bead between the projecting portions.

7. The golf club head according to claim 1, wherein a main body of the golf club head is made of a titanium alloy, and wherein the weld bead is made of pure titanium.

* * * * *